US005919104A

United States Patent [19]

Mortvedt et al.

[11] Patent Number: 5,919,104

[45] Date of Patent: Jul. 6, 1999

[54] LONG STRING RACQUETS, PARTICULARLY FOR RACQUETBALL

[75] Inventors: Raymond Lee Mortvedt, Santee; Ronald Alan Grimes, Encinitas; Todd Berdell Colburn, San Diego, all of Calif.

[73] Assignee: EF Composite Technologies, L.P., San Diego, Calif.

[21] Appl. No.: 08/638,439

[22] Filed: Apr. 26, 1996

[51] Int. Cl.[6] ..... A63B 49/08

[52] U.S. Cl. ..... 473/540; 473/549; 473/538

[58] Field of Search ..... 473/540, 542, 473/524, 549, 538, 534, 537

[56] References Cited

U.S. PATENT DOCUMENTS

| | | | |
|---|---|---|---|
| 2,089,118 | 8/1937 | Fritsch | 473/534 |
| 4,196,901 | 4/1980 | Durbin | 473/537 |
| 4,333,650 | 6/1982 | Soong | 473/537 |
| 4,531,738 | 7/1985 | Mortvedt et al. | 473/537 |
| 4,595,201 | 6/1986 | Fischer | 473/534 |
| 4,613,138 | 9/1986 | Haythornthwaite | 473/534 |
| 4,754,968 | 7/1988 | Fischer | 473/534 |
| 4,765,621 | 8/1988 | Game | 473/534 |

*Primary Examiner*—Raleigh W. Chiu

[57] ABSTRACT

A racquet with strings and a handle has at least a portion of the strung length of at least some of its strings at least partially within a cavity defined by the racquet's handle, and/or, in the case of a racquet having a shaft, a cavity defined by the racquet's shaft. Typically two, or some multiple of two, strings are extended in strung length by at least a portion of the length of the handle's (shaft's) cavity. The cavity may be but only slightly recessed into the handle (shaft), and may be nearly as long as is the handle (shaft) itself. Particularly in the case those racquetball racquets qualified by the 1996 rules of the American Amateur Racquetball Association to twenty one inches (21") in total length, each of preferably two or more "long" strings commonly extend at least fifteen and one-half inches (≧5½"), and may extend as long as twenty and one-half inches (>20½"), in strung length by virtue of extending within the cavity of a hollow handle. The "long" strings are subject to being displaced a greater distance from the plane of the racquet during ball strikes and strokes than are the shorter strings for which they substitute, beneficially permitting (i) a greater energy storage in the strings and racquet frame, (ii) a larger sweet spot, longer ball contact, and (iii) a more prolonged and greater return of energy to the struck ball.

44 Claims, 5 Drawing Sheets

LONG STRING RACQUETS, PARTICULARLY FOR RACQUETBALL

BACKGROUND OF THE INVENTION

1. Field of the Invention

The present invention generally concerns all racquets such as, commonly, have both (i) strings and (ii) handles.

The present invention particularly concerns (i) the construction of handles, and also shafts if any be present, and (ii) the routing of the strings, of racquets having both strings and handles and/or shafts in order that (i) the length of certain strings may be greatly increased, and, according to this increase, (ii) the dynamics of the racquet response during the striking of balls may be enhanced.

The present invention still further particularly concerns racquets, and particularly racquetball racquets, having long longitudinal strings.

2. Description of the Prior Art 2.1 Previous Racquets of Altered Physical Form and Dynamical Properties The prior racquet art as taught in the Head patent U.S. Pat. No. 3,999,756; the Durban patent U.S. Pat. No. 4,196,901; the Mortvedt patents U.S. Pat. Nos. 4,531,738 and 4,618,147 (Re. 34,067 and Re. 34,068); and other patents, clearly describe the benefits to playability afforded by maximizing the area, and the attendant main string length, of the striking area of stringed racquets.

An early patent with respect to the altered properties of oversize racquets was U.S. Pat. No. 3,999,756 for a TENNIS RACQUET to Howard Head assigned to Prince Manufacturing, Inc. The well known oversize Prince® tennis racquet (Prince is a registered trademark of Prince Manufacturing, Inc.) enjoyed excellent market success. As explained in the patent: "[t]he racquet has a zone of high coefficient of restitution, much larger than that of conventional racquets, extending in a longitudinal direction from the region of the center of percussion . . . . The zone of high coefficient of percussion is also wider with respect to the corresponding zone on conventional racquets."

Although the analysis in U.S. Pat. No. 3,999,756 is primarily with respect to zones, or areas—the Prince® tennis being an "oversize" racquet—an analysis of the effect of string length on the force imparted to struck (tennis) balls is particularly contained at FIGS. 13–17 of the patent and in the associated text.

Another patent discussing the effects of both string tension and string length in a racquet is U.S. Pat. No. 4,196,901 to Durban for a TENNIS RACQUET. This patent states at column 2, line 41, et seq. that, "[t]o compensate for the absence of transverse bracing in the throat portion of the racquet the longitudinal strings are tensioned somewhat higher than the transverse strings . . . . This tends to spread and stiffen the frame at the throat portion . . . . " It further states at column 2, line 53, et seq., that "[w]ith the new, open-throated construction several of the center longitudinal strings will be longer than in a conventional racquet (having a fully elliptical playing head) and the center pair of strings may be as much as 4" longer. This is believed to contribute to the unique "lively action" that players experience using the new racquet."

Several sworn representations were made as to the effect and the utility of longer strings by the same Raymond Mortvedt who is a co-inventor of the present application during of the prosecution of his applications assigned to Ektelon, San Diego (Ektelon® is a registered trademark of Prince Manufacturing, Inc.), leading to U.S. Pat. Nos. 4,531,738 and 4,618,147. These patents were respectively reissued as U.S. Pat. No. Re. 34,067 for a RACQUETBALL RACQUET WITH INCREASED HITTING AREA IMPROVED RACQUETBALL RACQUET CONSTRUCTION and U.S. Pat. No. Re. 34,068 for a RACQUETBALL RACQUET WITH INCREASED HITTING AREA. It was, for example, stated in AFFIDAVITs of Mr. Mortvedt on Mar. 28, 1990, and Dec. 14, 1994, that "a [r]adar gun test, using accomplished players [was] showing consistently about 7 to 10 percent higher ball velocities than conventional racquets because of, . . . (2) the longitudinal moment of inertia [of the oversize racquetball racquet] is approximately 30 percent higher [than a conventional racquetball racquet] ... that the main and the cross strings . . . in the impact zone are 30 to 40 percent longer . . . . "

2.2 Limitations on Racquet Size

In summary, the prior art can fairly be said to suggest, if not forthrightly teach, that larger racquets which have, innately, longer strings have discernably different, and arguably better, properties of play. Based on this history, and this rationale, it would be expected that gigantic racquets would have appeared somewhere, sometime, in most if not all racquet sports. Alas, there are countervailing considerations to making racquets ever larger. Clearly the general limitations of space, weight and manipulation difficulties posed by racquets of extreme large size limit the physical size of these racquets. In addition, most racquet sports (as well as other sports including golf and hockey) have rules that, among other things, regulate the physical characteristics of the equipments with which the sport is played.

Ruling bodies, such as the International Tennis Federation (ITF), and American Amateur Racquetball Association (AARA), have placed geometric limits on racquets used in events under their respective sanctions. This tends to guide racquet manufacturers into compliance with the limitations. For example, tennis rackets shall not exceed 32 inches in overall length.

Further by example, and by way of illustration, the racquet sport of racquetball is predominantly (if not exclusively) regulated by the rules of the American Amateur Racquetball Association (AARA). The AARA rules require that the overall length of a racquetball racquet should not exceed twenty one inches (21").

The nature of the game of racquetball, and the use of racquetball racquets therein, has so far required that the racquetball racquet should have a peripheral handle. The absolute minimum size handle that a very few adult players with extremely small hands can use effectively is three and one half-inch inches (3½") in length. The practical minimum handle length for a commercially sold racquet is four inches (4"), but a large percentage of racquet sports players will complain about a handle of this length as being "too short", and will be highly resistant to purchase a racquetball racquet having such a short handle. Most players normally require a handle for gripping a racquetball racquet which handle is greater than four inches (4") in length, and which is more commonly more than five inches (5") in length.

Moreover, each string of a racquet must be connected at each of its ends to the racquet frame. If two times one-half inch (2×½"), or one inch (1") total, is considered to be the combined thickness of the frame at the two opposing connection points to which a string is routed, and five inches (5") is considered to be the nominal length of the handle, then the subtraction of these necessary minimum distances from the twenty-one inch (21") maximum length of the frame makes that the maximum length of the longitudinal strings is limited to approximately fifteen inches (15").

This has in fact been the case. Because of the necessary thickness of the frame and length of the handle, the maximum length of the main strings of racquetball racquets—routed along the major axis of the racquet, which axis runs through the handle—has heretofore been less than fifteen inches (15"). The longest racquetball racquet strings previous to the present invention known to the inventors were the 14.8" to 14.9" strings appearing on the EMINENCE™ and ALUSION™ model racquetball racquets manufactured by Ektelon corporation; the 14.9" strings appearing on the GRAPHITE ASSAULT™ model racquetball racquet manufactured by Spalding corporation; the 14.9" strings appearing on the PHASE II™ model racquetball racquet manufactured by Transition Sports corporation; and 14.8" to 14.9" strings appearing on the REAL DEAL model racquetball racquet manufactured by EF Composite Technologies, Limited Partnership (assignee of the present invention).

2.3 Dynamics of Stringed Racquets

Large racquets generally play better than small racquets within the considerable limits of considerations related to (i) air resistance, (ii) moment of inertia, (iii) center of gravity, (iv) moment of the lever arm presented by the handle and grip, (v) string and frame materials, and (vi) the contact with, and the energy imparted to, various types and speeds of balls upon various strokes of a racquet as may be administered by various players.

It is not difficult to discover that the dynamics of the sport of racquetball, in particular, and the striking of a regulation racquetball ball, could greatly benefit from a larger racquet. It is much easier and more effective to accelerate a racquetball ball to high velocity by "serving" with a tennis racquet as opposed to a racquetball racquet, as may be conveniently determined by sports radar in an outdoor environment. It is also possible to build oversize, non-conforming racquetball racquets and to exercise, and to quantify the performance of, these racquets in play, including in competitive play between experts on regulation racquetball courts.

However, and as previously discussed, there are competing considerations to increasing the size of racquets. It would accordingly be desirable if some of the dynamical performance advantages of an oversize racquet could somehow be incorporated into existing smaller, and/or regulation, racquets. The present invention concerns all racquets—including but not limited to tennis racquets and squash racquets and badminton racquets and racquetball racquets (both regulation AARA-qualified and not so qualified). The present invention is directed to improving racquets of all types so as to realize the dynamics, and the "play-ability" of much larger racquets in a smaller form factor.

SUMMARY OF THE INVENTION

The present invention contemplates a racquet having strings and a handle (and, possibly, also a shaft) wherein at least a portion of a strung length of at least one of the racquet's strings is at least partially within a cavity defined by the racquet's handle (and/or the racquet's shaft). Typically several strings so have at least a portion of their strung length located within the cavity of the racquet's handle (and/or shaft). These strings are normally the very longest strings on the racquet. Typically two, or some multiple of two, such "long" strings are strung so that each proceeds, at least in a part of its length, within the cavity of the racquet's handle (and/or shaft).

One particular, preferred, racquet so constructed is configured, adapted and officially qualified by Rules of the American Amateur Racquetball Association as existing in 1996. In this racquet at least one, and more commonly two or four or some higher multiple of two, strings each exceed fifteen and one-half inches (15½") in strung length, and may commonly be as great as twenty and one-half inches (20½") in strung length, by virtue of being at least partially contained within a handle to the racquetball racquet.

1. Definitions

The present invention concerns strung and handled racquets, meaning racquets that have a handle and sometimes also a shaft, and that are susceptible of being strung. Such racquets have a frame. The racquet's handle, and its shaft if any be present, are part of the racquet's frame. The frame defines a "strung area" of the racquet where are present the racquet's strings.

The strings are typically in free space within the strung area. The strings may, however, be subject to minor obstructions within the strung area such as typically induce slight bends in the strings. These minor obstruction may include, for example, (i) structures such as, for example, dampers, internal fair leads, and the inside walls of a shaft or a handle where the string passes over these inside walls, and/or (ii) other strings. A string is not within the strung area, conversely, where it is strongly contacted by the frame or any other structure, such as, for example, at a connection point, at a tie point, or at a location where, by force of contact, the string bends more than 30° and is thus strongly constrained in further transmission of force or vibration.

Similarly, the "strung length" of a string is not the maximum extent thereof, but always includes that portion that is in free space plus any extent of the string (if any such exists) that is subject to only minor obstructions such as, for example, (i) slight bends caused by contact with other structures and/or strings and/or passage over the inside walls of a shaft or a handle, (ii) damping structures, and/or (ii) internal fair leads. The "strung length" of a string does not include portions of the string beyond where it is strongly contacted by, or even secured to, the frame or other structure (such as, for example, at a connection point or a tie point), nor any portion of the string beyond where it bends more than 30° and is thus strongly constrained in transmission of force or vibration.

The "striking area" of the racquet is that portion of the "strung area" (which portion is necessarily less than or equal to the strung area) that is visible from an imaginary point displaced perpendicularly from the plane of the racquet. A struck ball can contact this "striking area", but may be, in accordance with the present invention, precluded from impinging upon all of the "strung area" by a handle or shaft.

For the purposes of the present disclosure a "handle" shall mean that portion of a racquet that is functionally engaged by the hand or hands in use of the racquet. A "handle" in accordance with the present invention is capable of enclosing a volume, and of defining a cavity.

A "shaft" is that enclosed portion of a racquet between its handle and its striking area. Not all racquets have a shaft. For example, racquetball racquets are typically considered not to have shafts. Some forms of racquets, particularly early aluminum frame tennis racquets, have multiple, commonly two parallel, struts for a shaft. Any volume that is between these struts is not actually "within" the shaft nor is it within any cavity of the shaft, and this volume is specifically excluded from what is meant by a "shaft". A "shaft" within the present specification disclosure encloses a volume, and can define a cavity within the volume.

2. A Racquet Having Strings Within Its Handle, and/or Its Shaft

A strung and handled racquet in accordance with the present invention may be regarded as being characterized by having at least a portion of a strung length of at least one of the racquet's strings located at least partially within (i) a cavity that is defined by the racquet's handle, or, for shafted racquets, (ii) a cavity that is defined by the racquet's shaft and/or (iii) a cavity that is defined by both the racquet's shaft and handle.

3. A Racquet Having a Handle (and/or Shaft) Overlying a Strung Area

Alternatively, a racquet in accordance with the present invention may be regarded as having (i) an oblong frame defining a strung area, and (ii) a handle (and/or shaft) to the frame. In this racquet (i) the handle (and/or shaft) is at least partially hollow, and (ii) the strung area tapers in width to less than a width of the hollow handle (and/or shaft), the hollow handle (and/or shaft) overlying a portion of the strung area of the frame where so tapered. Normally at least one string is strung in the portion of the strung area that is overlaid by the hollow handle (and/or shaft). This string commonly has the longest strung length of any string of the racquet.

The racquet may, in particular, be configured and adapted and officially qualified as a racquetball racquet by rules of the American Amateur Racquetball Association as existing in 1996. In this eventuality, the at least one string of the racquet that is at least partially within the portion of the strung area that is overlaid by the hollow handle exceeds, by virtue of so being partially within the hollow handle, fifteen and one-half inches (15½") in strung length. (Racquetball racquets are commonly considered to have no shaft.) This is a record "long string" for a regulation racquetball racquet, and is exemplary of why the present invention is called "long string racquets".

4. A Racquet Having a Handle (and/or Shaft) That Intersects a Line Of Sight Between an (i) Imaginary Point Displaced From the Plane of the Racquet and (ii) At Least a Portion of At Least One String Still further alternatively, and as yet another way of regarding the present invention, a racquet in accordance with the invention may be considered to have (i) a frame, substantially in a plane, that defines a boundary, (ii) a handle (and/or shaft) to the frame at one end of the frame, which handle (and/or shaft) has and defines a cavity disposed towards the other end of the frame, and (iii) strings to the frame that, while still in free space within the boundary of the frame, are positioned relative to the cavity of the handle so as to be visually obscured by any handle (and/or shaft) that is opaque from an imaginary view point removed from the plane of the frame. Another way of saying the nearly same thing is that the racquet's handle (and/or shaft) will intersect a line of sight between a imaginary point displaced from the plane of the racquet and at least a portion of at least one string.

The frame is normally oblong, and longer in a first imaginary axis running through the handle's (shaft's) cavity than it is in a second imaginary axis perpendicular to this first axis. In this configuration at least some of the at least partially obscured strings connect from (i) at least one frame location that is within the cavity of the frame's handle (and/or shaft), and are thus visually obscured to the imaginary view point where so connected, to (ii) at least one other frame location that is located roughly oppositely upon the frame roughly in the direction of the imaginary first axis.

The number of partially obscured strings connecting to locations within the cavity of the frame's hollow handle (and/or shaft) may be equal to, or greater than, the number of locations where are connected strings that are at least partially obscured. This is simply to say that there may be one, or more than one, partially-obscured strings connected at each in-handle (in-shaft) connection location.

5. A Racquet Having a Handle (and/or Shaft) Visually Obscuring a Frame Location Whereat At Least One String Connects Still further alternatively, and as still yet another way of regarding the present invention, a racquet in accordance with the present invention may be regarded as having (i) an oblong frame, longer in a first imaginary axis than in a second imaginary axis perpendicular to this first axis, that defines a boundary and that lies substantially in a plane. A handle (and/or a shaft) to the frame is located at one end of the frame. This handle (and/or shaft) has and defines a cavity disposed toward the other end of the frame. Strings to the frame proceed along the first imaginary axis and connect at a frame location that is visually obscured by the frame's handle (and/or shaft)—at least when such handle (and/or shaft) is opaque—from an imaginary view point displaced from the plane of the frame. As before, another way of saying nearly the same thing is that the racquet's handle (and/or shaft) will intersect a line of sight between a imaginary point displaced from the plane of the racquet and at least one connection point for at least one string.

6. A Racquet With Frame Boundary Points to Strung Strings Where At Least One Frame Boundary Point Is Within a Handle (and/or Shaft)

Still further alternatively, and as still yet another way of regarding the present invention, an (unstrung) racquet in accordance with the present invention may be regarded as having a frame defining a boundary—within which boundary strings are strung between frame boundary points. Furthermore, a handle (and/or shaft) to the frame is at least partially relieved to such an extent that at least one frame boundary point is located within the handle (shaft). In use of the racquet, strings are strung between the frame boundary points, including that at least one frame boundary point that is within the handle (shaft).

The handle (and/or shaft) is sometimes relieved hollow over at least half its length, with at least some, or even all, of the at-least-some frame boundary points to which strings are strung being embedded so deeply within the hollow so to be at least halfway deep within the handle's (and/or shaft's) overall length. Indeed, the handle (and/or shaft) may be hollow over substantially all its length, with those at-least-some in-handle boundary points to which strings are strung being embedded substantially as deep within the hollow of the handle (and/or shaft) as the handle (and/or shaft) is long. Indeed, for racquets having both a handle and a shaft, both the handle and the shaft may be hollow over substantially the entire length of each, with those at-least-some in-handle boundary points to which strings are strung being embedded being substantially as deep within the combined hollows of the handle and of the shaft as the handle and shaft taken together are long.

Nonetheless to the presence of any hollows in the handle and/or shaft, both the handle and/or the shaft are quite normal in size and in shape (at least in external contour). Moreover, in the region of such hollow handle (and/or hollow shaft) the frame is quite normal in shape and in thickness, as well as being fully compatible in shape and in form with the shape of the handle (and/or shaft), and vice versa. Namely, the visible portion of the frame's handle (and/or shaft) is, in essence, in the topological form of a tube, or cylinder, serving to cover the underlying frame, with the relieved volume of the handle (and/or shaft) being located between opposing sides of the frame where the frame is covered by the (topologically) tubular handle (and/or shaft).

Focusing on the frame, as opposed to the frame regions of the "handle" and/or the "shaft", is simply yet another way of characterizing the present invention. It is submitted that it is a useful way of characterizing the invention. In thinking about the present invention, it is unduly restrictive merely to envision racquets as being divided into separate regions of a frame-bounded striking area plus a handle plus an optional shaft. Instead, it is more useful to think of the frame-bounded striking area as being all inclusive, with the handle (s) and any shaft(s) fitted thereto, and there over.

Once this mental boundary is crossed, and a stringed racquet is no longer thought of as a striking area plus and appended handle plus, optionally, an appended shaft, but is rather thought of as a striking area to which is integrated a handle region and a shaft region, then it is possible to construct stringed racquets of many diverse forms other than simply those forms of the preferred embodiments of the present invention. For example, a racquet could be shaped like a horseshoe crab that is grabbed by its tail. For example, a racquet could be shaped like a much foreshortened version of a modern-form racing oar as is commonly used in the sport of crew. Many exotic forms of racquets are possible once it is realized, as is taught by the present invention, that the string dynamics of the striking area need not end at the handle, and/or the shaft.

Further, the frame is sometimes notched and/or beveled in the region where the strung area, and the strings strung thereon, enter the handle (and/or shaft). Both notching and beveling are useful to present a smooth contour between this strung area of the frame and the frame's handle (and/or shaft).

Finally, an optional fairing, or damper, that is commonly shaped as an integral part of a surface of the handle may be located between opposing sides of the frame in this same region where the strung area, and the strings strung thereon, enter into the handle (and/or the shaft). The optional fairing permits passage of at least one string that is strung between frame boundary points a one of which boundary points is within the handle (and/or shaft). The one or more strings may be either (i) unconstrained, or (ii) variously individually selectively variously constrained, such as by visco-elastic materials, in passage through the fairing. This optimal, selective, constraint is why the fairing is called a "damper".

For example, the fairing itself may optionally include foam rubber or like material. Additionally, or alternatively, the fairing may optionally serve to hold foam rubber or other material within the cavity of the handle (and/or shaft), and at locations to the sides of the strings that are also within the cavity. This optional form of the fairing, and/or the optional in-handle (in-shaft) material, permits a damping of the motion of the string(s) of the racquet which are within the cavity of the handle (and/or shaft). This damping may occur over an extended length that is typically so long as is that portion of the length of each string that is within the cavity. The material may also serve to dampen structural shock and vibration as is felt by the player's hand and arm.

The present invention thus contemplates the damping, and the selective damping, and the variable selective damping, of string motion and vibration in a stringed racquet.

7. A Shaft-less Racquet Where the Sum of the Length of the Handle Plus a Longest String Exceeds the Overall Length of the Racquet Still further alternatively, and as still yet another way of regarding the present invention, a racquet (of a type without a shaft) in accordance with the present invention may be regarded as having a total length—excluding small thicknesses of the frame where opposite ends of a string are attached—of Z inches, where Z is an arbitrary positive number.

Such a racquet without a shaft has (i) a frame defining a strung area, and (ii) a handle to the frame that is X inches in length, where X is also and arbitrary positive number (necessarily) less than Z (X<Z). The racquet further has (iii) at least one string within frame's strung area which string is at least Y inches in strung length, where Y also is an arbitrary positive number again (necessarily) less than Z (Y<Z).

In accordance with the present invention X+Y>Z.

Typically, several strings within frame's strung area are each at least Y inches in strung length where Y>Z−X.

For example, the racquet may in particular be a racquetball racquet that is configured and adapted and officially qualified by 1996 rules of the American Amateur Racquetball Association, meaning that the total racquet length is no longer than 21 inches. The measurement Z, or total length minus the typical one-half inch (½") thicknesses of the frame at each of two opposite ends where a string is attached, is thus 21"−(2×½")=20", i.e., Z=20". Consider also, for example, that the frame's handle is at least five inches (5") in length; ergo X=5". In accordance with the present invention the length Y of at least one string within frame's strung area is greater than fifteen and one-half inches (15½"); ergo Y>15½".

Ergo, in accordance with the present invention X+Y>Z, or 5"++15½">20", or 20½">20".

Another way of expressing this same relationship is that Y>Z−X, namely 15½">20"−5", or 15½">15".

Yet another, alternative, way of expressing this relationship is that an exemplary racquetball racquet in accordance with the present invention that is, in particular, configured and adapted and officially qualified by 1996 Rules of the American Amateur Racquetball Association, is characterized for having at least one string that exceeds in strung length the maximum length of a racquetball racquet established by said Rules (i.e., 21") minus five and one half inches (5½"), or at least one string that exceeds in strung length 21"−5½", or 15½".

Still yet another way of expressing this relationship is that a racquetball racquet in accordance with the present invention that is, in particular, configured and adapted and officially qualified by 1996 Rules of the American Amateur Racquetball Association, is characterized for having at least one longitudinal string of the racquet exceeds in strung length approximately seventy-five percent of the maximum total allowable racquet length of said 1996 Rules of the American Amateur Racquetball Association. I.e., at least one longitudinal string of the racquet exceeds in strung length approximately 75% of 21", or approximately 15¾".

8. A Shafted Racquet Where the Sum of the Length of the Handle Plus the Shaft Plus a Longest String Exceeds the Overall Length of the Racquet Still further alternatively, and as still yet another way of regarding the present invention, a racquet in accordance with the present invention that is of a type having a shaft may also, still, be regarded as having a total length—minus small thicknesses of the frame where opposite ends of a string are attached—of length Z, where Z is an arbitrary positive number.

Such a racquet has (i) a frame defining a strung area; (ii) a shaft to the frame that is of length W, where W is also and arbitrary positive number (necessarily) less than Z (W<Z); and (iii) a handle to the frame that is of length X, where X is also an arbitrary positive number again (necessarily) less than Z (X<Z). The racquet further has at least one string within frame's strung area which string is at least Y in strung length, where Y also is an arbitrary positive number again (necessarily) less than Z (Y<Z).

In accordance with the present invention W+X+Y>Z.

Typically, a number of strings within frame's strung area are each at least Y in strung length where Y>Z−X−W.

9. Methods of Making and Stringing Racquets

Still further alternatively, and as still yet another way of regarding the present invention, the present invention may be considered to be embodied in a method of making a stringed racquet. An area of a racquet frame is both strung and integrated with a hollow handle (shaft) which at least partially overlies the strung area of the frame.

The present invention may be considered to alternatively be embodied in a method of extending the strung length of at least some strings of a racquet which strings are strung between frame connection points. In this method at least one connection point is located within a hollow handle (shaft) of the racquet. At least one of the racquet's strings is then routed to the at least one connection point that is within the hollow handle (shaft) of the racquet.

Finally, the present invention may be considered to alternatively be embodied in a method of extending the strung length of at least one string of a racquet by routing at least a portion of at this at least one string within a hollow handle (shaft) of the racquet.

These and other aspects and attributes of the present invention will become increasingly clear upon reference to the following drawings and accompanying specification.

DESCRIPTION OF THE PREFERRED EMBODIMENT

Figure 1:
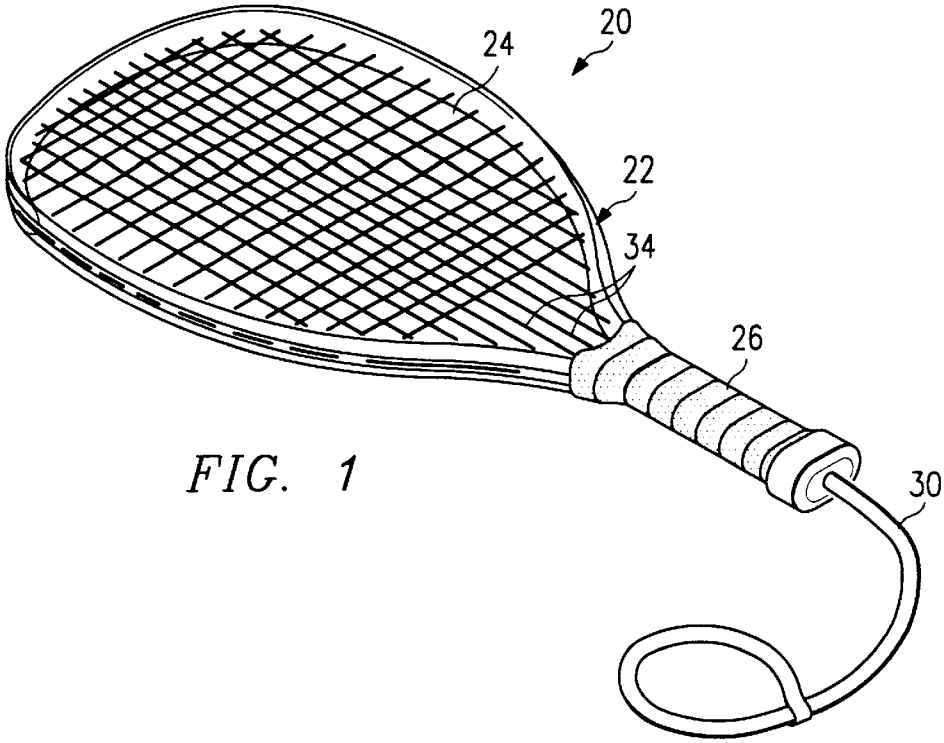
FIG. 1 is a diagrammatic perspective view showing a first preferred embodiment of a racquet, by way of illustration a racquetball racquet, in accordance with the present invention.

A first preferred embodiment of a racquet, by way of illustration a racquetball racquet 1, in accordance with the present invention is shown in diagrammatic perspective view in FIG. 1. The racquet 1 has a frame 11, strings 12, and a handle 111 to the frame 11. The racquet may be considered to also have a shaft 10; but in the case of the illustrated racquetball racquet 1, the racquet 1 is generally spoken of is being without a shaft, which means only that the shaft 10 has been collapsed to zero length. As the principles of the present invention are next explained, they will be understood to be applicable to racquets (such as tennis and squash and badminton racquets) that have a distinctly non-zero length shaft, and for that reason alone a shaft 10 (albeit of zero length) may be appropriately identified in FIG. 1.

The handle 111 is accorded an identification number "111" that categorizes it as a sub-assembly of the frame "11"

because, as is common in some modern racquets, the racquet's handle is structurally integral with its frame, and may actually comprise an extension region of the frame 11. (The shaft 10 is also sometimes structurally integral with the frame 11, and would have been a accorded an appropriate sub-frame identification number save that it is a nullity in FIG. 1.) Because the handle 111 will be seen in the present invention to serve in its interior regions to present connection, or anchor, points to some of the strings 12—the major function of the frame 11—it is especially suitable that it should be considered an extension region, and sub-assembly, of the overall frame 11. However, in those racquets where a cover (not shown) to the handle 111 is affixed, such as by slipping or by screwing (not shown) over a thin elongate extension to the frame 11, the principles of the present invention as are next discussed will still apply.

The frame 11 may also optionally connect a lanyard 13 at its handle 111.

Notably, at least from the perspective of FIG. 1, a (racquetball) racquet 1 in accordance with the present invention is not externally highly visually dissimilar from similar racquets of the prior art. The racquet 1 looks different, and then only but somewhat different, mostly in the area of its throat 112 to its frame 11 and to its frame handle 11; all as may best be envisioned by momentary reference to (i) the x-ray view of FIG. 2, (ii) the view without strings 12 of FIG. 3, and (iii) the partial cut-away view (of a variant embodiment of the racquet) of FIG. 12. This slight difference is that selected longitudinal ones of the strings 12 proceed into the throat region 112, and onwards into the inside cavity of the handle 111. Otherwise, the racquet 1 is commonly made from the same composite and/or metal materials as are existing racquets.

Figure 2:
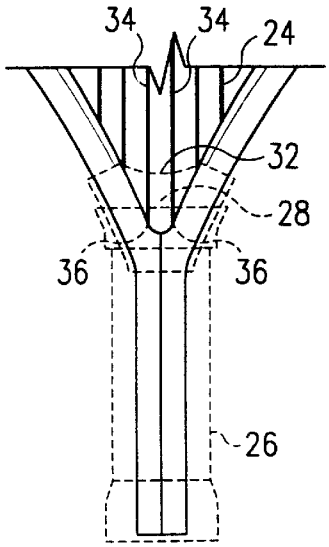
FIG. 2 is a side plan cut-away x-ray detail view of the throat and handle area of the first preferred embodiment of the racquetball racquet in accordance with the present invention previously seen in FIG. 1.

FIG. 2 is a cut-away and x-ray detail side plan view particularly showing the throat area 112 and the handle 111 of the first preferred embodiment of a racquetball racquet 1 (previously seen in FIG. 1). At least some selected longitudinal ones of the strings 12 may be immediately observed to extend so far into the throat 112 so as to be obscured from a side right-orthogonal view by the external shell of the handle 111. Conversely, the handle 111 may be immediately observed to be of such size and extent as does mask from right orthogonal visual view the connection points of at least some of the strings 12. The selected strings 12 extend within the handle 111, and, conversely, the handle 111 extends over the strings, while these selected strings 12 are still in free space, and within the strung area of the racquet 1.

The new handle 111 is typically of completely normal size in both length and diameter, normally respectively about five inches (5") in length and about three and one-half inches (3½") to four inches (4") in diameter for a racquetball racquet. The new handle 111 is, however, cooperatively inter-operative with a frame 11 of a new contour—of which frame 11 the handle 111 which is a part. The handle is so inter-operative particularly in the region of the frame's throat 112 so as to permit that one or more selected ones of the strings 12 extend into the interior cavity of the handle 111. To the extent that the selected ones of the strings 12 do so extend into the handle 111 then they are longer—i.e., "long strings"—than they would otherwise be should they not so extend.

Figure 3:
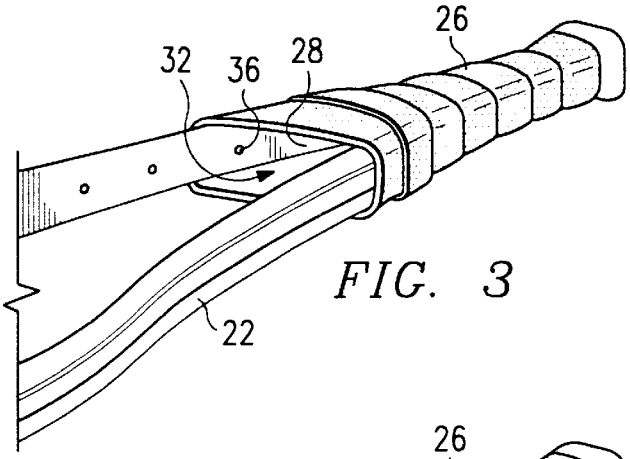
FIG. 3 is a diagrammatic perspective view showing the throat area of the first preferred embodiment of the racquetball racquet in accordance with the present invention previously seen in FIG. 1.

A diagrammatic perspective view particularly showing the throat area 112 of the first preferred embodiment of the racquetball racquet 1 in accordance with the present invention (previously seen in FIG. 1) without the strings 12 affixed is shown in FIG. 3. It may be observed that at least some of the string connection points 113 of the frame 11 are inside a cavity defined by the handle 111.

Figure 4:
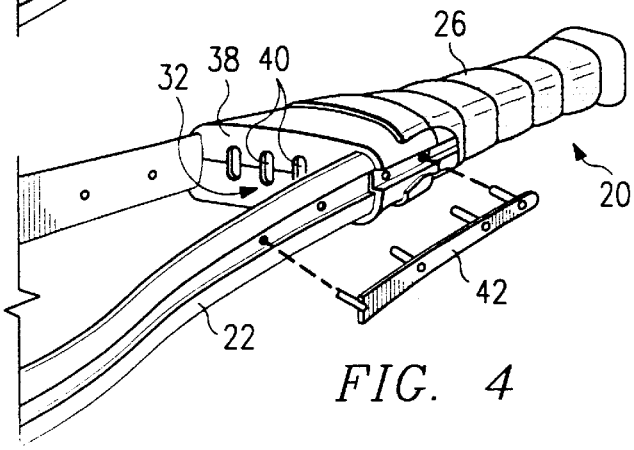
FIG. 4 is a diagrammatic perspective view showing an optional further treatment of the throat area of a racquetball racquet in accordance with the present invention, which treatment may either be in addition to, or alternative to, the treatment previously seen in FIG. 3.

A diagrammatic perspective view showing an optional treatment of the throat area 112 of a racquetball racquet 1 in accordance with the present invention is shown in FIG. 4. A "damper" 114 is inserted into the region of the throat 112, and spans between opposing interior sides of the frame 11 typically at, or near, entrance into the frame's handle 111. The damper 114 has and defines apertures 1141 through which selected longitudinal ones of the strings 12 (shown in FIGS. 1 and 2, not shown in FIG. 4) enter into the interior cavity of the handle 111. The apertures 1141 of the damper 114 may be equal, or less, in number than the number of longitudinal strings passed. The apertures 1141 may be elongated in an imaginary axis transverse to the plane of the frame 11, as illustrated, in order to accommodate the free movement of the selected strings 12, which movement is predominantly in this axis.

The apertures 1141 to the damper 114 can be so large so as to prevent that the damper 114 should ever come into contact with such one(s) of the selected strings 12 as pass through the apertures 1141 of the damper 114 and into the handle 11. However, it will be understood that the sides of the apertures 1141, and the damper 114, may optionally contact the selected strings 12 for purposes of damping the motion(s) and vibration(s) thereof without defeating the essential purposes of the present invention (at least so long as selective ones of the selected strings 12 are ultimately connected, such as at connection points 113, inside the handle 111).

The damper 114, which is sometimes called a fairing, may itself optionally include, consist of, or incorporate foam rubber or like visco-elastic material of various shapes and sizes. Additionally, or alternatively, the damper 114 may optionally serve as a retainer piece to hold foam rubber or other visco-elastic material (not shown) within the cavity of the handle 111 (and/or any shaft). Any such damping material is normally held at the sides of, and contacts, the selected ones of the strings 12 that are also within the cavity of the handle 111. This optional material serves to damp the motion(s) and vibration(s) of those selected ones of the strings 12 of the racquet 1 which are within the cavity of the handle 111 (and/or any shaft).

One or more external pieces 115 may be affixed to the frame 11, including at locations of its throat 112 and its handle 111 and at locations spanning between the throat 112 and the handle 111. These pieces 115 are affixed for structural, decorative, string protection and/or shock-absorbing reasons.

It is also useful to consider that, since selective ones of the strings 12 are now routed inside the handle 111, it is useful and even necessary that access should be obtainable to the interior of the handle ill in order to string, and to re-string, the racquet 1. One possible mechanical construction so supporting access is to have an exterior grip, or sleeve (not shown) portion of the handle 111 loosen by action of a manipulation of a retention mechanism (not shown) of like nature and location to the butt cap **111*b*3 shown in FIG. 12, and to slide backwards off the frame 11**.

However, a practitioner of the mechanical design arts will recognize that there are many ways that access can be achieved to the string connection points, of which connection point 113 is typical, at the interior of the handle 111. Indeed, insofar as any external, or grip, portion (not shown) of the handle 111 is to be removable in order to support access, then it immediately becomes inherent that this grip portion may be replaced, or substituted, as the owner/user of the racquet 1 prefers. Such replacement or substitution might transpire in order to replace a worn grip, or to substitute a grip of a different material, and/or one having different frictional, elastomeric, and/or textural properties.

It is even clearly possible to envision substitute grips that are some fractions of an inch (centimeter) longer or shorter, or slightly thicker or thinner in diameter. Indeed, when it is later discussed that the tension of those selective ones of the strings 12 that are within the handle 111 may be varied, it may be envisioned that the grip surface to the handle 111 itself might be compressively deformed in the manner of a bulged, or a stretched, cylinder made from elastomeric material.

Indeed, because of a great multiplicity of such variants, it is apparent that the present invention—while both motivated by the desire to, and principally serving to, lengthen selected racquet strings—contemplates an whole new degree of sophistication for the handle of racquets, particularly including racquetball racquets. In so considering modifications to the handles of racquets, it should be kept in mind that hollow racquet handles in accordance with the present invention have a reasonable amount of volume, and that a reasonable amount of weight may acceptably be placed in these racquet handles. The racquet handles are thus supportive of all sorts of modifications. Furthermore, and specifically unlike the rules of, in particular, golf which rules forbid certain modifications to the handles of golf clubs, the rules of racquet sports generally currently permit all sorts of modifications and variations to racquet handles.

Figures 5, 6, 7, 8, 9:
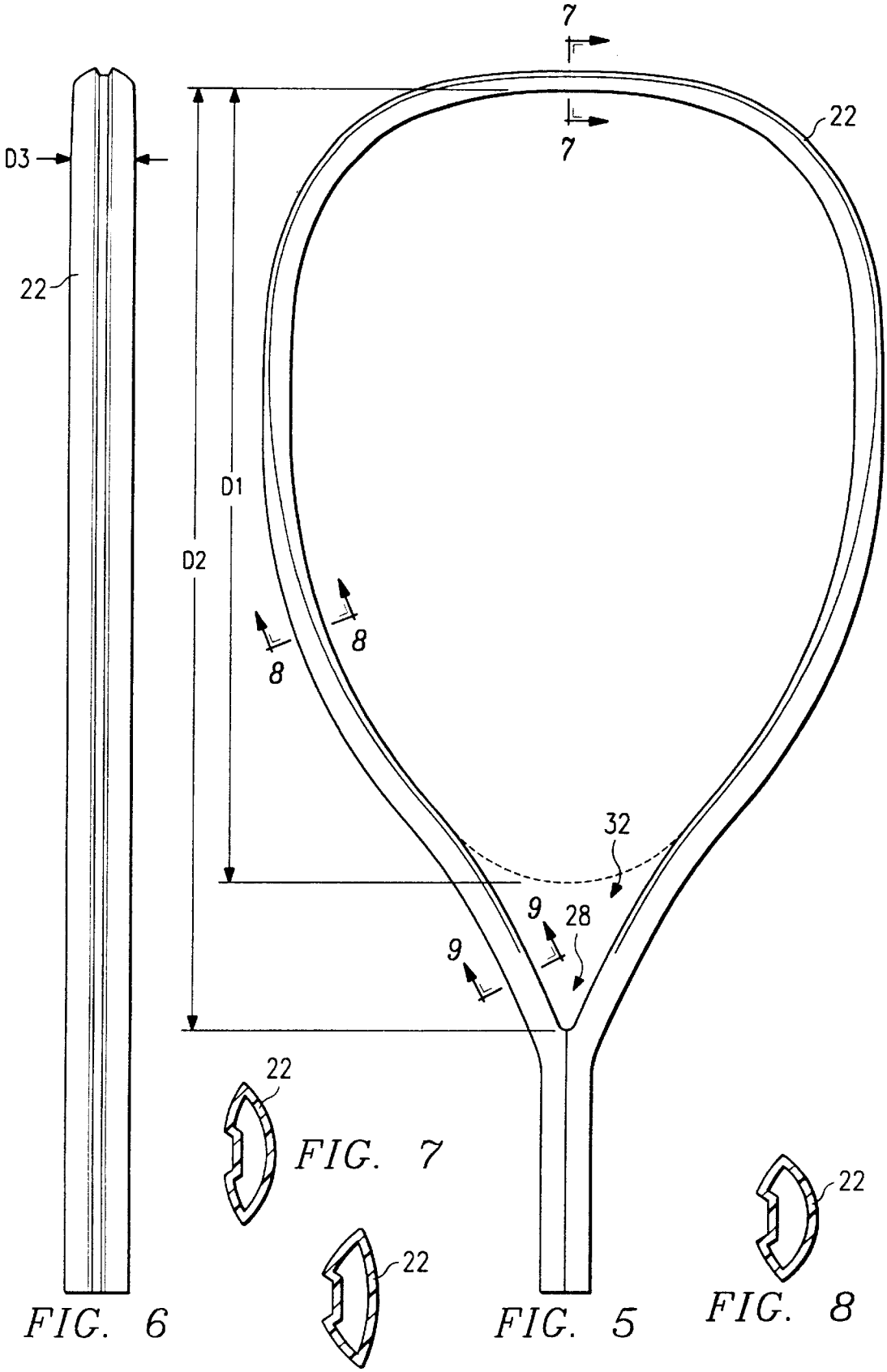
FIG. 5 is a side plan view of the frame of the first preferred embodiment of the racquetball racquet in accordance with the present invention previously seen in FIG. 1.
FIG. 6 is a edge plan view of the frame of the first preferred embodiment of the racquetball racquet in accordance with the present invention previously seen in FIG. 1.
FIG. 7 is a cross-section view of the frame of the first preferred embodiment of the racquetball racquet in accordance with the present invention taken along lines 7—7 shown in FIG. 5.
FIG. 8 is a cross-section view of the frame of the first preferred embodiment of the racquetball racquet in accordance with the present invention taken along lines 8—8 shown in FIG. 5.
FIG. 9 is a cross-section view of the frame of the first preferred embodiment of the racquetball racquet in accordance with the present invention taken along lines 9—9 shown in FIG. 5.

Continuing in explanation of racquets in accordance with the present invention as shown the figures, FIGS. 5 though 9 illustrate the typically sophisticated three-dimensional contours of the frame 11 of the racquet 1 (previously seen in FIGS. 1–4). A side plan view of the frame 11 of the first preferred embodiment of the racquetball racquet 1 is shown in FIG. 5, an edge plan view of this same frame 11 in FIG. 6, and cross-sectional views respectively taken along aspect lines 7—7, 8—8 and 9—9 of FIG. 5 respectively in FIGS. 7, 8 and 9.

A frame 11 that possesses the distinctly variable contour and cross section shown in FIGS. 5–9 is, by and large at the present time (circa 1996) and at least for racquets of top quality, common. The distances D1–D5 are, in particular for the first preferred embodiment of a racquet 1, nominally approximately 15½", 16¼", 9/10", ¾", and 9/10".

A major showing of FIGS. 5–9 as regards the present invention is—other than showing that racquets 1 in accordance with the present invention do not lack normal advanced structural characteristics—that the frame 111 at the region of its throat 112 is normally (i) relatively thick in a direction transverse to the plane of the racquet, and (ii) relatively thin in the frame of the racquet (perpendicularly to the lineal axis of the frame). This is best shown by the cross-section view of FIG. 9 (which view is taken along aspect line 9—9 of FIG. 5). This contour permits the frame 11 of the racquet 1 to be more commodious to accommodate the extension of (more) of selected strings 12 into the region, and the interior, of the handle 111, while blending and conforming to handle's shape and while still maintaining desired structural strength in the frame 11.

Figure 10:
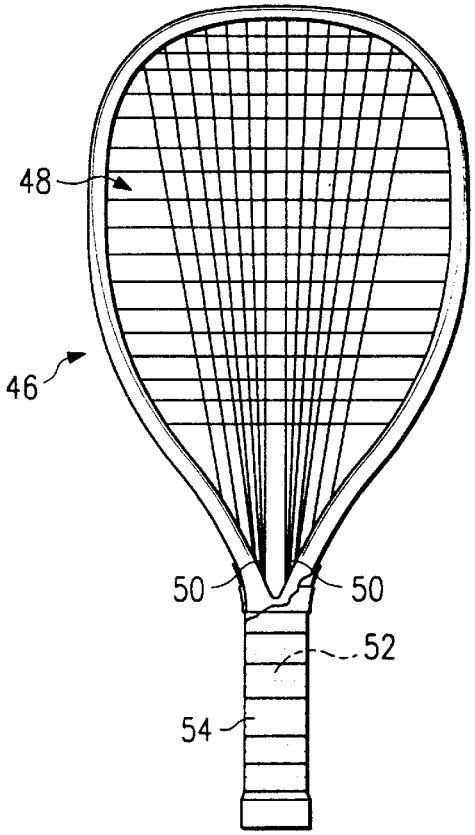
FIG. 10 is a side plan view showing a variant of the first preferred embodiment of a racquetball racquet in accordance with the present invention previously seen in FIG. 1.

A side plan view, partially in cut away, of a variant la of the first preferred embodiment of a racquetball racquet 1 in accordance with the present invention is shown in FIG. 10. The FIG. 10 pattern depicts multiple strings 12 that connect, at least at one end, to common frame boundary points. The strings 12*a* may be strung in the illustrated pattern, or in variants thereof, that is commonly known as a "sunburst", or a "flare", pattern. Notably, the pattern (or its variations) is continued even with those selected strings 12*a* that pass into the interior of the handle 111*a*.

Figure 11:
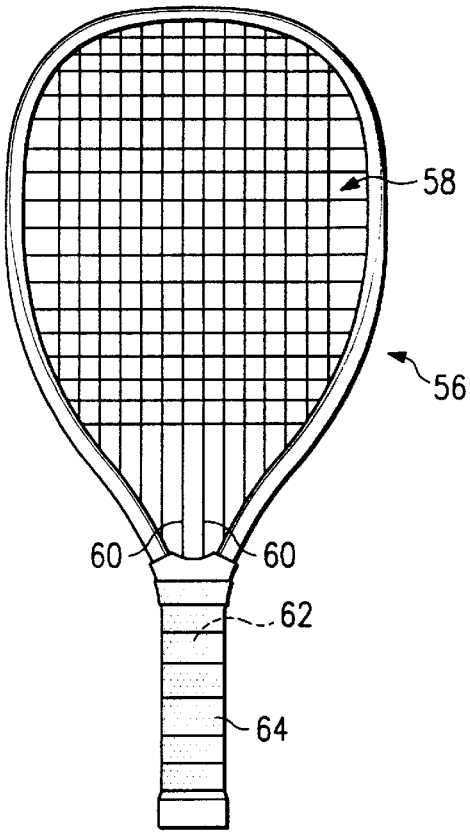
FIG. 11 is a side plan view showing a second preferred embodiment of a racquet, again by way of illustration a racquetball racquet, in accordance with the present invention.

This may be contrasted with yet another, second, preferred variant 1*b* embodiment of a racquetball racquet 1 in accordance with the present invention as is shown in FIG. 11. In this embodiment the strings 12*b* are strung in a conventional grid array pattern. Nonetheless to uniform string spacing, typically at least two selected ones of the strings 12*b* pass into the interior of the handle 111*b*.

Figure 12:
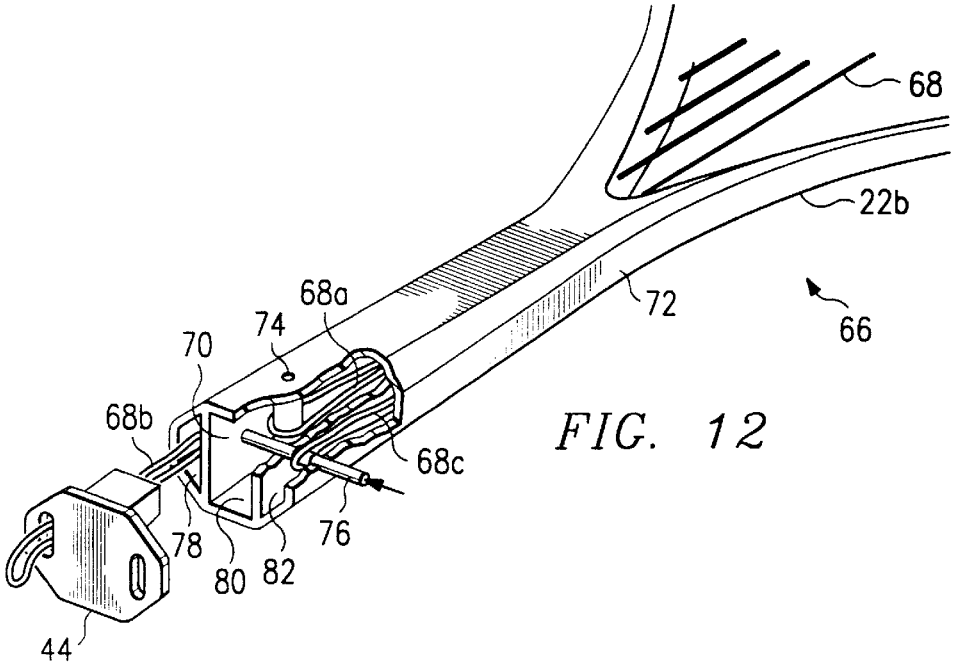
FIG. 12 is an exploded cut-away detail view illustrating one variant of the handle of the second preferred embodiment of the racquetball racquet in accordance with the present invention previously seen in FIG. 11.

An exploded cut-away detail view of a handle 111*b* of the second preferred embodiment 1*b* of a racquet 1 in accordance with the present invention is shown in FIG. 12. In this embodiment of the racquet 1*b* typically from four to ten central (in the elongate axis of the racquet) selected ones of the strings 12*b* pass very, even optimally, deeply into the interior of the hollow handle 111*b*. A first pair of selected strings 12*b*1, which pair are actually but a one string doubled over, are wrapped around a post 111*b*1. A second and a third pair of selected strings 12*b*2, 12*b*3—which pairs are again actually each but one string doubled over—are each wrapped around a pin 111*b*2. A butt cap 111*b*3, typically molded of plastic, permits access to one or more of the string pairs 12*b*1–12*b*3. The pin 111*b*2 may also, optionally, be used to attach the lanyard 13 (shown in FIG. 1, not shown in FIG. 12).

Clearly all selected string pairs 12*b*1–12*b*3 could be wrapped around a same retaining pin or other structure, normally in the same axis. The complexity is for good and proper reason. First note the tight clearance of the outside strings (i.e, pairs 12*b*2, 12*b*3) to the handle 111*b*. In order that these strings may be "full-floating", they are anchored to a pin 111*b*2 (or other structure) that has an axis that is aligned with, or transverse to, the thick direction of the handle 111*b*. Central string pair 12*b*1 might optionally also be anchored to this same pin 111*b*2. Instead the central string pair 12*b*1 is anchored to post 111*b*1. Finally, the multiple "channels" in the handle 11*b* add strength.

Second note in the racquet 1*b* that each of the string pairs 12*b*1–12*b*3 not only extends, full-floating, very deeply into the handle 111*b*, but each pair may optionally be positioned so as not to contact any other pair. Indeed, the illustrated handle 111*b* may be considered to have and present elongate internal channels, or cavities, in which individual string pairs both run, and are isolated from other string pairs. Other embodiments, such as that of FIGS. 14 through 18 are contra, with the "long" strings touching other long strings, or even passing over themselves in loops, within the handle. It is unusual in a racquet for nearly co-parallel (as opposed to substantially perpendicularly intersecting) strings 12 to touch, and the properties of play imparted thereby are still being explored.

The net run length of each of the six center strings 12*b*1–12*b*3 is typically approximately twenty and one-half inches (20½") if the racquet is a racquetball racquet.

Figure 13:
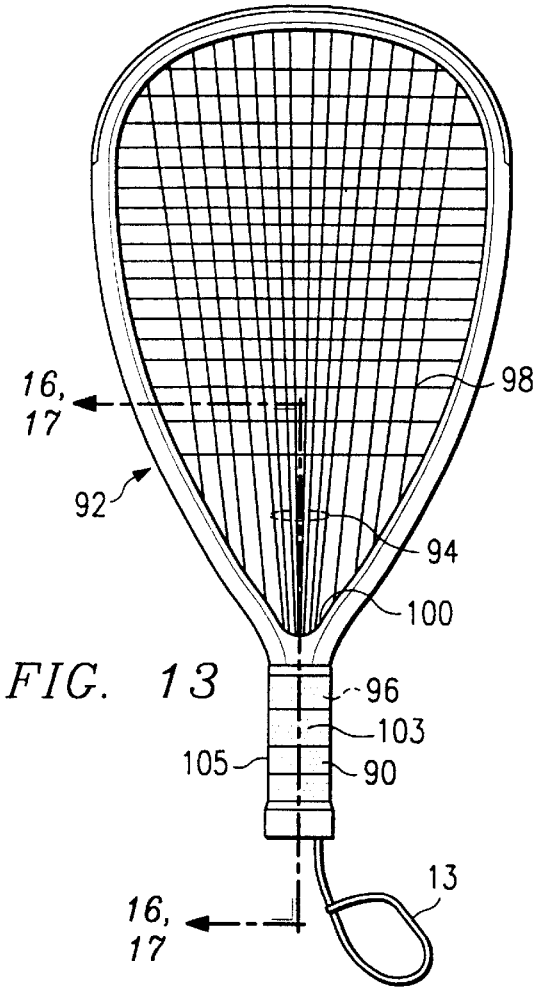
FIG. 13 is a side plan view showing a third preferred embodiment of a racquet, again by way of illustration a racquetball racquet, in accordance with the present invention.

A side plan view showing yet another, third, preferred embodiment of a racquet 1*c*, again by way of illustration a racquetball racquet, in accordance with the present invention is shown in FIG. 13. The illustrated racquet 1*c* has 3×2, or 6, strings 12*c* within the cavity of its handle 111*c*. Indeed, all the longitudinal strings could be routed into the cavity of the handle 111*c*. Some central ones of the selected strings 12*c* can extend in free space all the way to their in-handle anchor points. Other, more peripheral, ones of the selected strings 12*c* would, in passing into the handle 111*c*, contact the sides of the throat of the handle 111*c*. This contact does not negate the importance of the present invention to these peripheral selected strings: they will to a lessor extent also enjoy a modified "long string" performance. Remember that the "strung length" of a string is not defined as only that portion that is in free space but also includes such extent of the string as is subject to only minor obstructions such as, for example, those slight bends caused by contact with inside walls of the handle 111*c*. These bends, which are less than 30°, still permit the selected peripheral strings to transmit some force and/or vibration beyond the point of bending.

Figure 14:
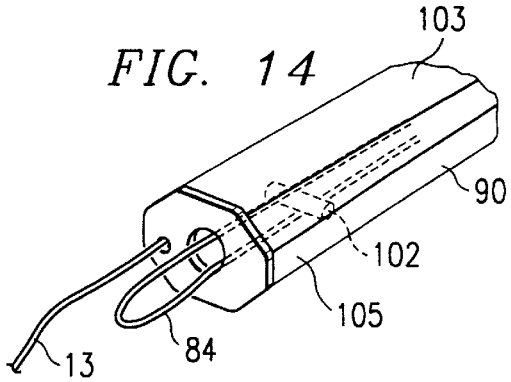
FIG. 14 is an x-ray detail view illustrating an exemplary first variant of the handle of the third preferred embodiment of the racquetball racquet in accordance with the present invention previously seen in FIG. 13.

An x-ray detail view illustrating an exemplary first variant of the handle 111*c*1 of the third preferred embodiment racquet 1*c* of FIG. 13 is shown in FIG. 14. The anchor pin 111*c*11 is in the substantial plane of the racquet 1*c*, as was the anchor pin 111*b*2 (previously seen in FIG. 12) of the handle 111*b* variant of the racquet 1*a* and 1*b* embodiments.

Figure 15:
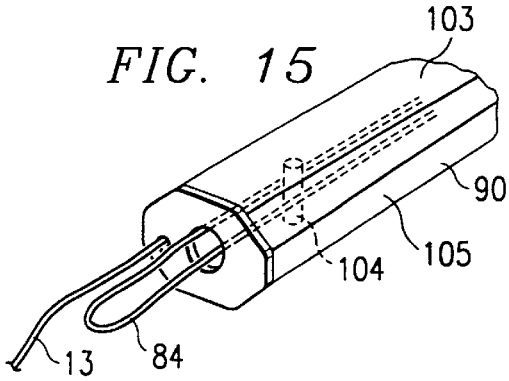
FIG. 15 is an x-ray detail view illustrating an exemplary second variant of the handle of the third preferred embodiment of the racquetball racquet in accordance with the present invention previously seen in FIG. 13.

Compare the x-ray detail view illustrating an exemplary second variant of the handle 111*c*2 (of the same third preferred embodiment of the racquetball racquet 1*c*) as is shown in FIG. 15. The anchor pin 111*c*21 is now substantially perpendicular to the plane of the racquet 1*c*, opposite to the anchor pin 111*b*2 (previously seen in FIG. 12) of the handle 111*b* variant of the racquet 1*a* and 1*b* embodiments, and opposite to the anchor pin 111*c*1 variant of FIG. 14.

Figure 16:
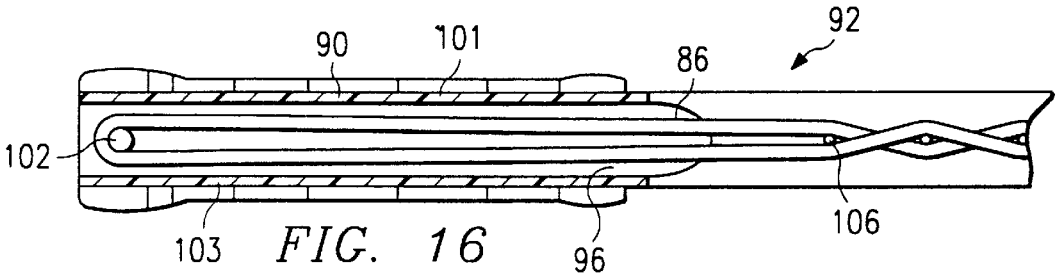
FIG. 16 is a cut-away detail view illustrating an exemplary first variant of the stringing of the first variant handle of the third preferred embodiment of the racquetball racquet in accordance with the present invention previously seen in FIG. 13.

A cut-away detail view illustrating an exemplary first variant of the stringing of the first variant handle 111*c*1 of the third preferred embodiment of the racquetball racquet 1*c* is shown in FIG. 16. Note that the longitudinal strings 12*c*1 within the handle 111*c*1 remain on the same side of the anchor pin 111*c*11 as the they are on the closest transverse string 121 of the racquet.

Figure 17:
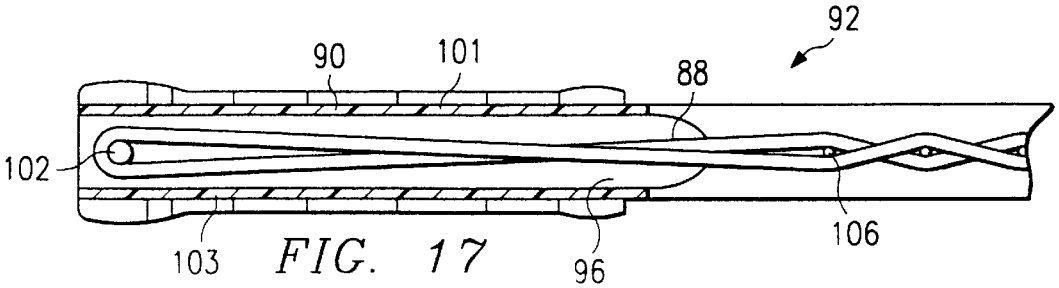
FIG. 17 is a cut-away detail view illustrating an exemplary second variant of the stringing of the first variant handle of the third preferred embodiment of the racquetball racquet in accordance with the present invention previously seen in FIG. 13.

Compare the cut-away detail view illustrating of an exemplary second variant of the stringing of the same first variant handle 111*c*1 of the same third preferred embodiment of the racquetball racquet 1*c* shown in FIG. 17. The longitudinal strings 12*c*2 within the handle now cross over to the opposite side of the anchor pin 111*c*11 from the side at which they are routed over the closest transverse string 121 of the racquet, forming a figure eight within the cavity of the handle 111*c*1. Obviously a combination of the string routings of both FIGS. 16 and 17 may be realized on the same racquet.

Figure 18:
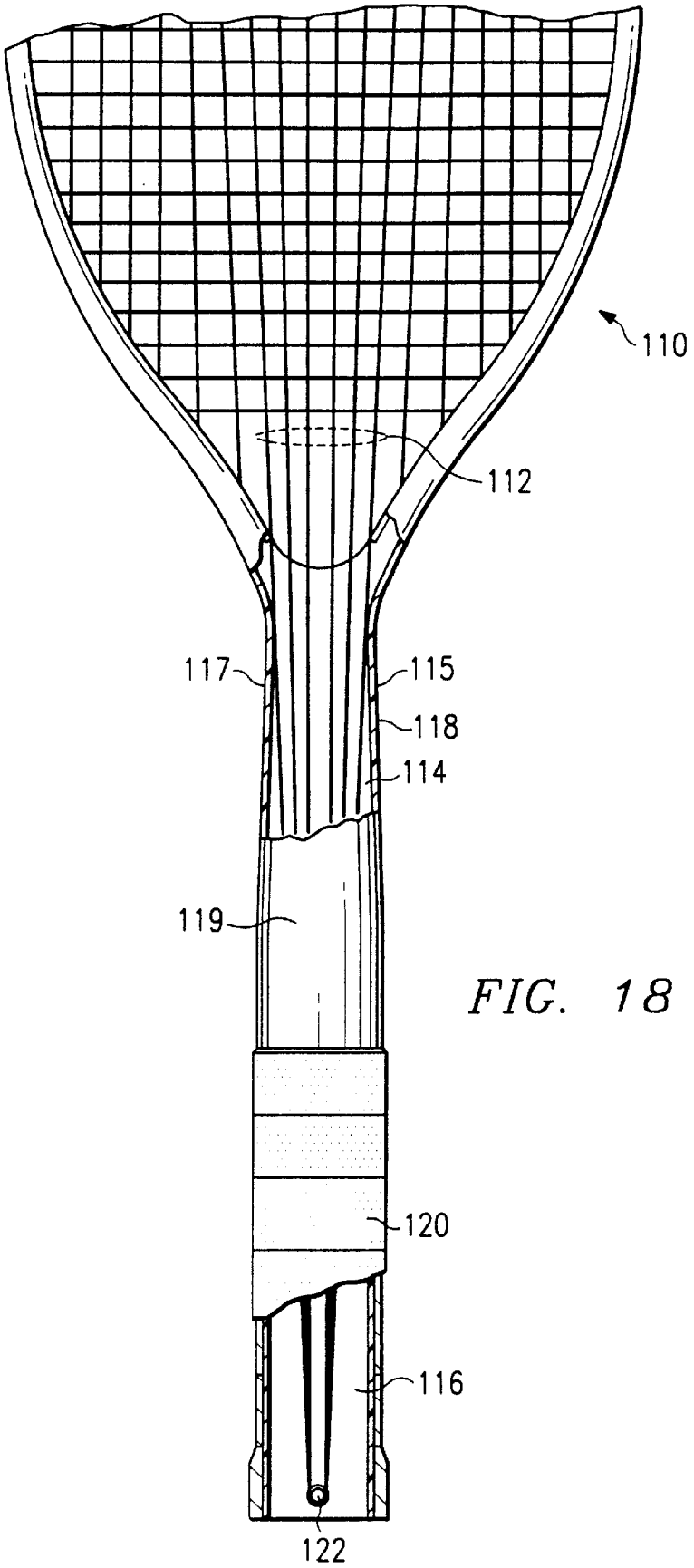
FIG. 18 is a side plan view, partially in cut-away, of a preferred embodiment of a shafted racquet, by way of illustration a tennis racquet, in accordance with the present invention.

A side plan view, partially in cut-away, of a preferred embodiment of a racquet 1*d* in accordance with the present invention having a more pronounced shaft 10*d* is shown in FIG. 18. The shafted racquet 1*d* is, by way of illustration, a tennis racquet. As is preferred, a multiple of two of the selected strings 12*d* proceed into the cavities of both the hollow shaft 10*d* and the hollow handle 111*d*. Preferably the illustrated six, or more, selected strings 12*d* so proceed, and these strings very deeply within the shaft 10*d* and the handle 111*d*, possibly to the full depth thereof.

In accordance with the preceding explanation, variations and adaptations of long string racquets in accordance with the present invention will suggest themselves to a practitioner of the mechanical and/or sporting good equipment design arts.

For example, it is now possible to envision selectively variably tensioning (at least) the long strings on the court, and during pauses in play. Consider FIG. 12. The post 111*b*1 and/or the pin 111*b*2 could be made rotatable, engaging one or more of the strings 12*b*1, 12*b*2, or 12*b*3 in the manner of a rotatable guitar, or a piano, pin. Clearly rotation of a pin around which a string(s) of the racquet were wound and engaged would serve to variably tension these strings.

This is not the only way to so realize variable string tension. Consider that the post 111*b*1 or the pin 111*b*2, or any like structure, could be captured and moved (as a screw follower) in location with the handle 111*b* by something as simple as a threaded screw the head of which is accessed from the butt end of the handle 111*b*. It would be a simple matter to turn such a screw in order to variably tension the strings 12*b*1–12*b*3, interior to the handle 111*b*, that were ultimately engaged thereby. The reasons that strings might desirably be adjusted in tension has to do with conditions of play, including the speed of the ball as is served or volleyed by a particular competitive opponent or, more likely, to compensate for tension loss due to normal effects of age, temperature, and humidity.

Still further, any of the post 111*b*1 or the pin 111*b*2 of FIG. 12, the anchor pin 111*c*11 of FIG. 14, or the anchor pin 111*c*21 of FIG. 15 could be made to be rotating, and may even be suspended for so rotating on bearings. A rotating point of string attachment makes that the extension of a one string is coupled, over the rotating anchor post or pin, to a neighboring string. This phenomenon also is still being investigated, but seems promising as a better and more efficient way to couple the energy that is stored within the racquet strings to a struck ball. One illustrative test is to simply fire balls at various constant velocities against racquets in accordance with the present invention that either do, or do not, have in-handle rotating anchor post(s) and/or pin(s).

Permutations and combinations of long strings, and variable tensioning of long strings, is still not the end of reasonable variations and adaptations to the present invention. It will be recalled that, in order to obtain access to and provide strength to support the long strings, a handle to a racquet of the present invention is not only of complex construction but, indeed, is often comprised of multiple parts. Some thought can be given, in particular, to the removable and replaceable grip of the handle. Such a grip might be varied in any of material type, surface finish, contour, and size in both length and thickness. By such variation the handle might be both personalized, and better adapted to varying conditions of play.

In accordance with these and other possible variations and adaptations of the present invention, the scope of the invention should be determined in accordance with the following claims, only, and not solely in accordance with that embodiment within which the invention has been taught.

What is claimed is:

1. A strung racquet comprising:

a frame having a top end and a bottom end and arranged along an axis from the top end to the bottom end, a handle of the racquet operatively connected to the bottom end of the frame, said handle having a length and disposed around said axis, strings strung across said frame and adapted to strike a ball or other gamepiece;

said handle including a cavity disposed along said axis and extending in a direction opposite the frame, an opening of the cavity facing said bottom end of said frame, at least one connection point disposed inside said cavity, at least one string strung to said connection point, that portion of said at least one string which is disposed in the cavity traversing free space with no or minor obstruction, such that the effective strung length of said at least one string is increased to include at least a portion of the length of the handle.

2. The racquet of claim 1, and further including a damper disposed in said cavity or across the opening thereof, said at least one string passing through said damper.

3. The racquet of claim 1, wherein said racquet is a tennis racquet, a racquetball racquet, a badminton racquet or a squash racquet.

4. The racquet of claim 1, wherein a plurality of said strings have portions disposed in the cavity, at least two of said plurality of strings touching each other within said cavity of said handle.

5. The racquet of claim 1, wherein a plurality of strings are strung to one connection point within said cavity of said handle.

6. The racquet of claim 1, wherein said cavity extends substantially the entire length of said handle, said handle having a bottom end opposed to said frame, said at least one connection point disposed at or near said bottom end of said handle.

7. The racquet of claim 6, wherein said cavity has a second opening in the bottom end of said handle, said cavity extending the entire length of said handle.

8. The racquet of claim 1, wherein said cavity has opposed sidewalls and wherein said at least one connection point disposed in said cavity is a post or pin spanning said cavity between said sidewalls.

9. The racquet of claim 1, and further comprising a hollow shaft interposed between said frame and said handle, said at least one string strung through said hollow shaft.

10. The racquet of claim 1, wherein said handle is directly connected to said frame.

11. The racquet of claim 1, wherein a plurality of connection points are disposed inside said cavity, a plurality of said strings disposed in said cavity each of said connection points receiving at least one of the last said strings.

12. The racquet according to claim 1, wherein said at least one string exceeds fifteen and one-half inches in strung length.

13. A strung racket comprising a frame having a top end and a bottom end and arranged along an axis from the top end to the bottom end, a shaft disposed along said axis and operatively connected to the bottom end of the frame, strings strung on said frame and adapted to strike a ball or other gamepiece, the racquet characterized in that said shaft includes a cavity disposed along said axis and extending in a direction away from the frame, at least one sidewall of said shaft defining said cavity and spaced from said axis, a first portion of said at least one sidewall spaced from said axis in a first direction orthogonal to said axis, a second portion of said at least one sidewall spaced from said axis in a second direction orthogonal to said axis and to said first direction, an opening of the cavity facing said bottom end of the frame, a plurality of said strings entering said cavity and having portions strung to be disposed within said cavity and traversing free space with no or minor obstruction, such that the effective strung length of each of the plurality of said strings is increased to include at least a portion of the length of said shaft.

14. The racquet of claim 13, wherein at least one connection point is disposed inside said cavity and displaced from said cavity opening, at least one of said strings strung to said connection point.

15. The racquet of claim 14, wherein said frame includes a top arc disposed at said top end thereof, at least one of said strings strung from one or more connection points on said top arc to said at least one connection point in said cavity or handle with no or minor obstruction.

16. The racquet of claim 15, wherein said shaft is opaque.

17. The racquet of claim 13, and further including a damper disposed in said cavity or across the opening thereof, said plurality of strings passing through said damper.

18. The racquet of claim 13, and further comprising a handle connected to said shaft to be opposed to said bottom end of said frame.

19. The racquet of claim 18, wherein said handle includes a cavity in communication with the cavity of said shaft, at least one connection point disposed inside said cavity of said handle, at least one of said plurality of strings connected to said at least one connection point.

20. The racquet of claim 18, wherein said cavity is at least partially disposed in, and extends substantially the entire length of, said handle, said handle having a bottom end opposed to said frame, said at least one connection point disposed at or near said bottom end of said handle.

21. The racquet of claim 20, wherein said cavity has a second opening in the bottom end of said handle, said cavity extending the entire length of said handle.

22. The racquet of claim 13, wherein a plurality of connection points are disposed within said cavity, each connection point receiving at least one of said strings.

23. The racquet of claim 13, wherein said cavity has opposed sidewalls and wherein at least one connection point disposed in said cavity is a post or pin spanning said cavity between said sidewalls.

24. The racquet of claim 13, wherein said racquet is a racquetball racquet, a tennis racquet, a squash racquet or a badminton racquet.

25. The racquet of claim 13, wherein said first portion of said at least one sidewall and said second portion of said at least one sidewall are integrally formed as a tube which laterally encloses said cavity.

26. The racquet of claim 13, wherein said shaft visually obscures a portion of said plurality of strings from a point of view normal to a plane including the frame.

27. A racquet having a frame defining a strung area and a handle operatively connected to the frame, a throat mounted at the junction of the handle and the frame and forming a circumferential margin of a cavity the cavity opening in the direction of the frame and extending into the throat, the strung area tapering in width to equal to or less than a width of the throat, the strung area proceeding into the cavity where so tapered, a plurality of strings of the strung area adaptable to contact a ball or other gamepiece and being partially disposed within the cavity and traversing free space within said cavity with no or minor obstruction.

28. The racquet according to claim 5, wherein said plurality of strings have the longest strung lengths of any string of the racquet.

29. A racquet comprising:

a frame lying substantially in a plane and defining a boundary of a strung area;

a handle operatively connected to the frame at a first end region of the frame, said handle including a cavity opening towards a second end region of the frame opposed to the first end region, at least one connection point disposed within said cavity; and a plurality of strings adaptable to contact a ball or other gamepiece and disposed in the strung area of the frame, the plurality of strings strung in free space with no or minor obstruction within the boundary of the frame and within said cavity to said at least one connection point, a portion of said handle interposed between respective portions of said plurality of strings and a viewer viewing the racquet from a point perpendicular to said frame.

30. The racquet according to claim 29 further comprising:

a hollow shaft connected to the frame located between the handle and an unobscured region of the strung area, wherein said plurality of strings to the frame also pass, while still in free space within the boundary of the frame, through the hollow of the shaft with no or minor obstruction.

31. The racquet according to claim 29, wherein the frame is oblong, and longer in a first imaginary axis running through the handle's cavity than in a second imaginary axis perpendicular to this first axis; and wherein a plurality of connection points are disposed in the cavity, and said plurality of strings connect from said connection points to other connection points that are located oppositely upon the frame roughly in the direction of the imaginary first axis;

wherein said plurality of strings extend furthest in free space of all strings of the racquet.

32. The racquet according to claim 29, wherein the plurality of strings connect to a plurality of connection points disposed within said cavity; and wherein each of said connection points receives at least a pair of said plurality of strings.

33. The racquet according to claim 29, wherein a plurality of strings connect to a plurality of connection points disposed within said cavity, at least one of said connection points receiving more than one pair of said plurality of strings.

34. The racquet of claim 29, wherein a plurality of connection points are disposed within said cavity, one string connected to each said connection point.

35. A racquet comprising:

a frame, longer in a first imaginary axis than in a second imaginary axis perpendicular to this first axis, defining a boundary and substantially in a plane;

a hollow shaft connected to the frame at one end of the frame and along said first imaginary axis, said shaft having at least a first portion spaced from said first imaginary axis in a first direction, and a second portion spaced from said first imaginary axis in a second direction orthogonal to the first direction, said first and second portions bounding a cavity having an opening which opens onto said frame; and strings of said racquet adapted to strike a ball or other gamepiece and strung across said frame and strung within free space within said cavity with no or minor obstruction.

36. A racquet comprising:

a frame defining a boundary, strings being strung between points on said boundary and adaptable to contact a ball or other gamepiece;

a handle operatively connected to the frame that is at least partially relieved to such an extent that some of said points are within the handle, strings strung to said some points being strung in free space with no or minor obstruction.

37. The racquet according to claim 36, wherein the handle is relieved hollow over at least half its length, the frame boundary points within the handle being embedded so deeply within the hollow as to be at least halfway deep within the handle's length.

38. The racquet according to claim 37 wherein said some boundary points are embedded so deeply within the hollow as to be at least halfway deep within the handle's length.

39. The racquet according to claim 37 wherein the handle is hollow over substantially all its length; and wherein said some boundary points are embedded substantially as deep within the hollow of the handle as the handle is long.

40. The racquet according to claim 36, wherein the frame is compatible in shape and form in the region of the handle with the shape of the handle, the handle forming a contour covering the underlying frame, the relieved volume of the handle being located between opposing sides of the frame.

41. The racquet according to claim 36, further comprising:

a fairing, located between opposing sides of the frame, that permits passage of a string to a frame boundary point within the handle.

42. A racquet according to claim 1, wherein said at least one string of the racquet exceeds in strung length seventy-five percent of the total length of said racquet.

43. A method of making a stringed racquet comprising:

integrating a hollow handle to the frame which hollow handle partially overlies the strung area of the frame; and stringing the frame such that a plurality of strings are adapted to strike a ball or other gamepiece and are disposed in free space within the hollow handle with no or minor obstruction.

44. A method of extending the strung length of at least some strings of a racquet which strings are strung between frame connection points, the method comprising:

locating at least one connection point within a hollow handle of the racquet; and routing at least one of the racquet's strings in free space with little or no or minor obstruction, to said at least one connection point.

* * * * *